US006389665B1

(12) United States Patent
Fuchs et al.

(10) Patent No.: US 6,389,665 B1
(45) Date of Patent: May 21, 2002

(54) FACILITY FOR NEEDLING OF FLEECE

(75) Inventors: Helmut Fuchs; Robert Strasser, both of Linz; Hannes Pum, Alberndorf; Günther Feyerl, Linz; Ludwig Legl, Buchkirchen; Hellmuth Stachel, Vienna, all of (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 09/665,014

(22) Filed: Sep. 19, 2000

(30) Foreign Application Priority Data

Oct. 8, 1999 (AT) ..... 1713/99

(51) Int. Cl.[7] ..... D04H 18/00
(52) U.S. Cl. ..... 28/114; 28/107
(58) Field of Search ..... 28/107, 114, 115, 28/111, 113, 109, 110; 112/80.4, 80.41, 80.42

(56) References Cited

U.S. PATENT DOCUMENTS 3,798,717 A * 3/1974 Brochetti ..... 28/107
5,502,879 A * 4/1996 Rinder ..... 28/115
5,511,294 A * 4/1996 Fehrer ..... 28/107
5,528,805 A * 6/1996 Leuchtenmuller et al. .... 28/115
5,548,881 A * 8/1996 Ludwig ..... 28/114
5,732,453 A * 3/1998 Dilo et al. ..... 28/114
5,822,834 A * 10/1998 Jourde et al. ..... 28/107
5,873,152 A * 2/1999 Jourde et al. ..... 28/107
6,000,112 A * 12/1999 Ollinger et al. ..... 28/114
6,161,269 A * 12/2000 Dilo et al. ..... 28/114
6,266,856 B1 * 7/2001 Fehrer et al. ..... 28/114

FOREIGN PATENT DOCUMENTS

DE 2 264 257 11/1993
DE 196 15 697 3/1997
EP 0 892 102 5/1998

* cited by examiner

*Primary Examiner*—Amy B. Vanatta
(74) *Attorney, Agent, or Firm*—Collard & Roe, P.C.

(57) ABSTRACT

The description relates to a facility for needling of fleece with at least one needle board driven to and fro in stitching direction, which can be additionally driven in pendulum fashion in fleece feed direction (15) by means of an eccentric drive, which is provided with a connecting rod (3) articulated to a rocker arm (4) and a connecting pitman (8) to the needle board effective on this connecting rod assembly. To be able to easily adjust the rocking amplitude of the needle board in fleece feed direction (15) it is suggested that the swivel bearing (5) of the rocker arm (4) is seated on a rotatable crank arm (6) and that, for adjustment of the rocking amplitude of the connecting pitman (8), the neutral rocking position of the rocker arm (4) is adjustable via the crank arm (6) between an end position essentially running in the direction of the connecting pitman (8) and an end position running transverse thereto.

3 Claims, 3 Drawing Sheets

FACILITY FOR NEEDLING OF FLEECE

FIELD OF THE INVENTION

The invention refers to a facility for needling of fleece with at least one needle board driven to and fro in stitching direction, which can be additionally driven in pendulum fashion in fleece feed direction via an eccentric drive provided with a connecting rod articulated at a rocker arm and a connecting pitman to the needle board effective on this connecting rod assembly.

DESCRIPTION OF THE PRIOR ART

To permit the fleece to be advanced also during engagement of the needles, it is known (DE 196 15 697 A1) to provide an additional needle board drive moving to and fro in fleece feed direction, so that the fleece feed is extended by the motion component of the needle board in fleece feed direction. Like the main drive effective in needle stitching direction, this additional drive for the needle board is realized via an eccentric drive, the connecting rods of which are articulated to the needle bar carrying the needle board. To adjust the rocking amplitude of this additional eccentric drive for the needle board effective in fleece feed direction, it is further known (EP 0 892 102 A2) to adjustably link the connecting rod of this additional eccentric drive to a rocker arm in such a way that the rocking amplitude of the rocker arm is changed upon displacement of the link. Therefore, via a pitman effective between this rocker arm and the needle board, the needle board can be driven in fleece feed direction at various rocking amplitudes. However, the disadvantage of this known construction is that a displacement of the connecting rod link at a rocker arm during driving of the needle board can be effected only by way of a very complex construction, so that, because of the usual demand for adjustability of the motion component of the needle board in fleece feed direction during driving of the needle board, an eccentric drive with such a connecting rod assembly is not used.

SUMMARY OF THE INVENTION

The invention has therefore the objective to design a facility for needling of fleece of the above mentioned kind in such a way that an easy adjustment of the range of the motion component of the needle board in fleece feed direction is ensured even during driving of the needle board.

The objective of the invention is achieved by the feature that the swivel bearing of the rocker arm is seated on a rotatable crank arm and that, for adjustment of the rocking amplitude of the connecting pitman, the neutral rocking position of the rocker arm is adjustable via the crank arm between an end position essentially running in the direction of the connecting pitman and an end position running transverse thereto.

By displacing the swivel bearing of the rocker arm, which is kept stationary except for its displacement for adjustment of the rocking amplitude of the needle board in fleece feed direction, instead of the articulated bearing of the connecting rod at the rocker arm moving along with the rocker arm, very simple constructions features are achieved for adjustment of the rocking amplitude of the needle board in fleece feed direction. It is only necessary to displace the swivel bearing of the rocker arm via a rotatable crank arm. If the neutral rocking position of the rocker arm is essentially running in the direction of the connecting pitman, the length of lift of this rocking drive is determined by the cosine of the swivelling angle of the rocker arm as against its neutral rocking position. In a neutral rocking position of the rocker arm running transverse thereto, it is the sine of this swivelling angle that is relevant for the achievable rocking amplitude, so that, in terms of the motion component of the needle board in fleece feed direction, there is a lower limit value for the neutral rocking position of the rocker arm in the direction of the connecting pitman and an upper limit value for the neutral rocking position running transverse thereto. Thus, the swivel bearing of the rocker arm must be adjusted via the crank arm in such a way that the neutral rocking position of the rocker arm as desired in each case is achieved between the two end positions, with the shaft of the crank arm preferably provided in the motion area of the articulating axle between the rocker arm and the connecting pitman, to avoid a distinct displacement of the connecting pitman along with the displacement of the swivel bearing of the rocker arm. Though the connecting pitman may be effective outside the articulating axle between the rocker arm and the connecting rod at the rocker arm or at the connecting rod, particularly simple construction features are achieved in this context, when the connecting rod, the rocker arm and the connecting pitman are interlinked via a common articulating axle.

To adjust the rocking amplitude of the needle board in fleece feed direction, differently designed rotating drives for the crank arm may be provided. If, to this end, the crank arm is equipped with a toothed quadrant meshing with a driving pinion, favorable adjustment features are achieved permitting in a simple way an inifinite rotary adjustment of the crank arm via the shaft of the driving pinion.

BRIEF DESCRIPTION OF THE DRAWINGS

The drawing depicts the subject matter of the invention.

DESCRIPTION OF THE PREFERRED EMBODIMENTS

Figure 2:
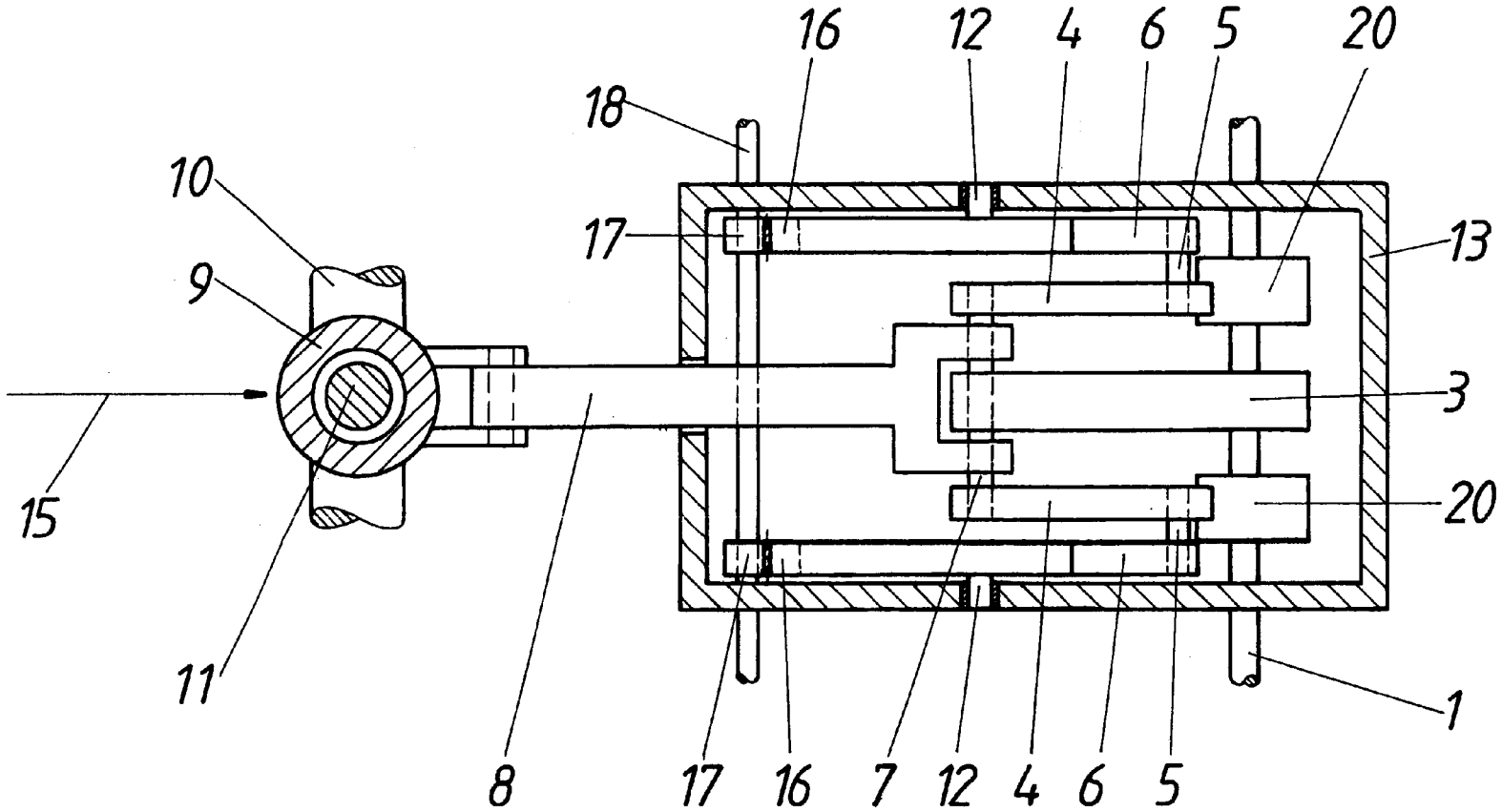
FIG. 2 depicts the eccentric drive acc. to FIG. 1 in a schematic section following the line II—II of FIG. 1.

The depicted eccentric drive is provided with a driven eccentric shaft I with an eccentric disc 2, on which a connecting rod 3 is borne rotatable. This connecting rod 3 is articulated to a rocker arm 4, the swivel bearing 5 of which is carried by a crank arm 6. As can be inferred from FIG. 2, the rocker arms 4 and the crank arms 6 are made up of pairs of parallel partial arms arranged at both sides of the connecting rod 3, which, however, does not influence the motion.

On the articulating axle 7 between the connecting rod 3 and the rocker arm 4, an additional connecting pitman is articulated, via which the connection between the eccentric drive and the needle board is established. To this, according to the example of embodiment, the connecting pitman 8 may be effective on a guide sleeve 9, pivoted around an axle 10 and accommodating a pushing rod 11 for the needle board drive moving to and fro in stitching direction. Though linking the connecting pitman 8 at the guide sleeve 9 has the advantage that the connecting pitman need not follow up with the to-and-fro board motion in stitching direction of the needle board, the depicted eccentric drive for the needle board drive in fleece feed direction may, of course, also be effective on the needle board and/or the needle bar.

Figure 1:
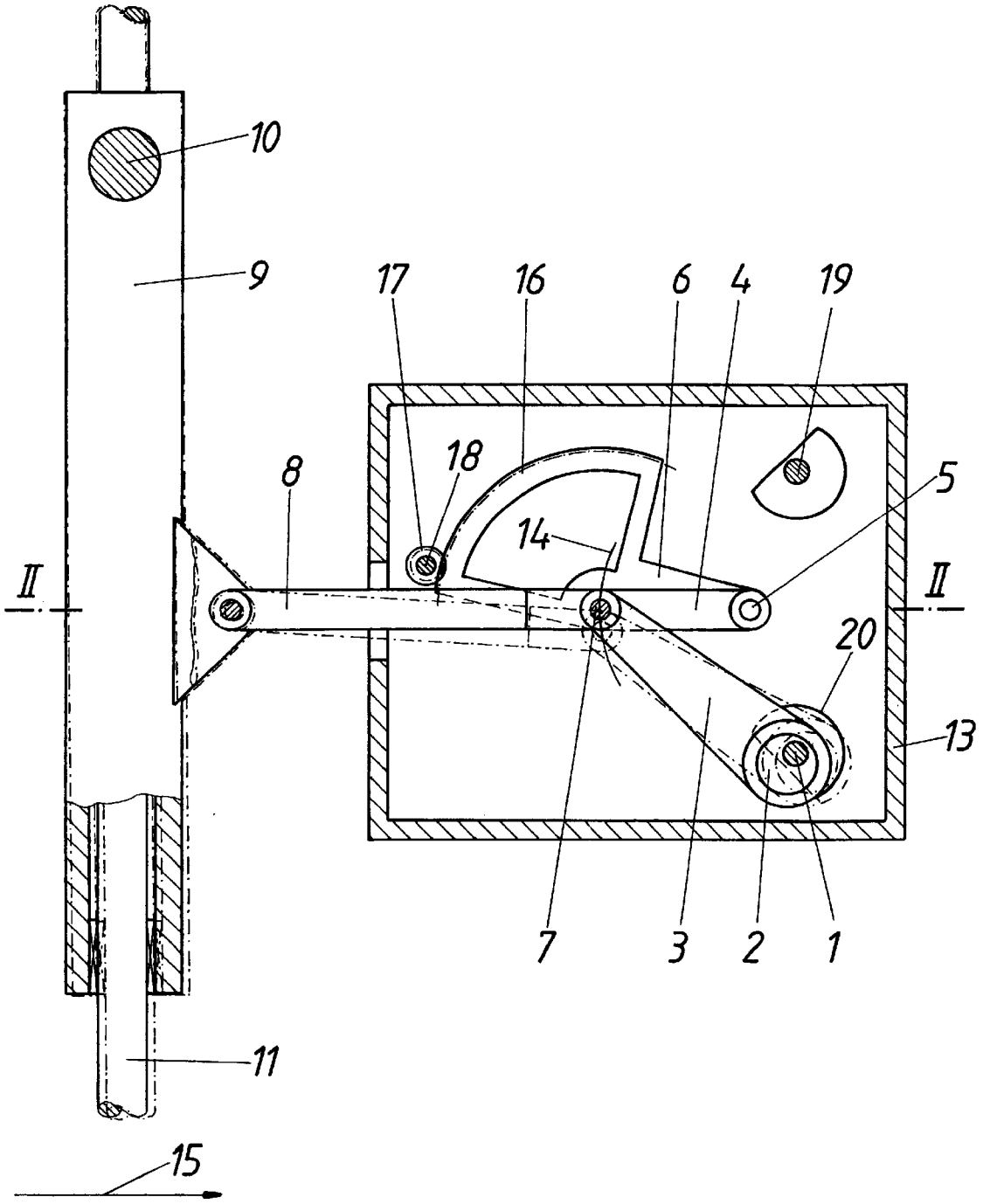
FIG. 1 shows an eccentric drive for the needle board drive in fleece feed direction of a facility for needling of fleece according to the invention in a schematic section vertical to the eccentric shaft.
Figure 3:
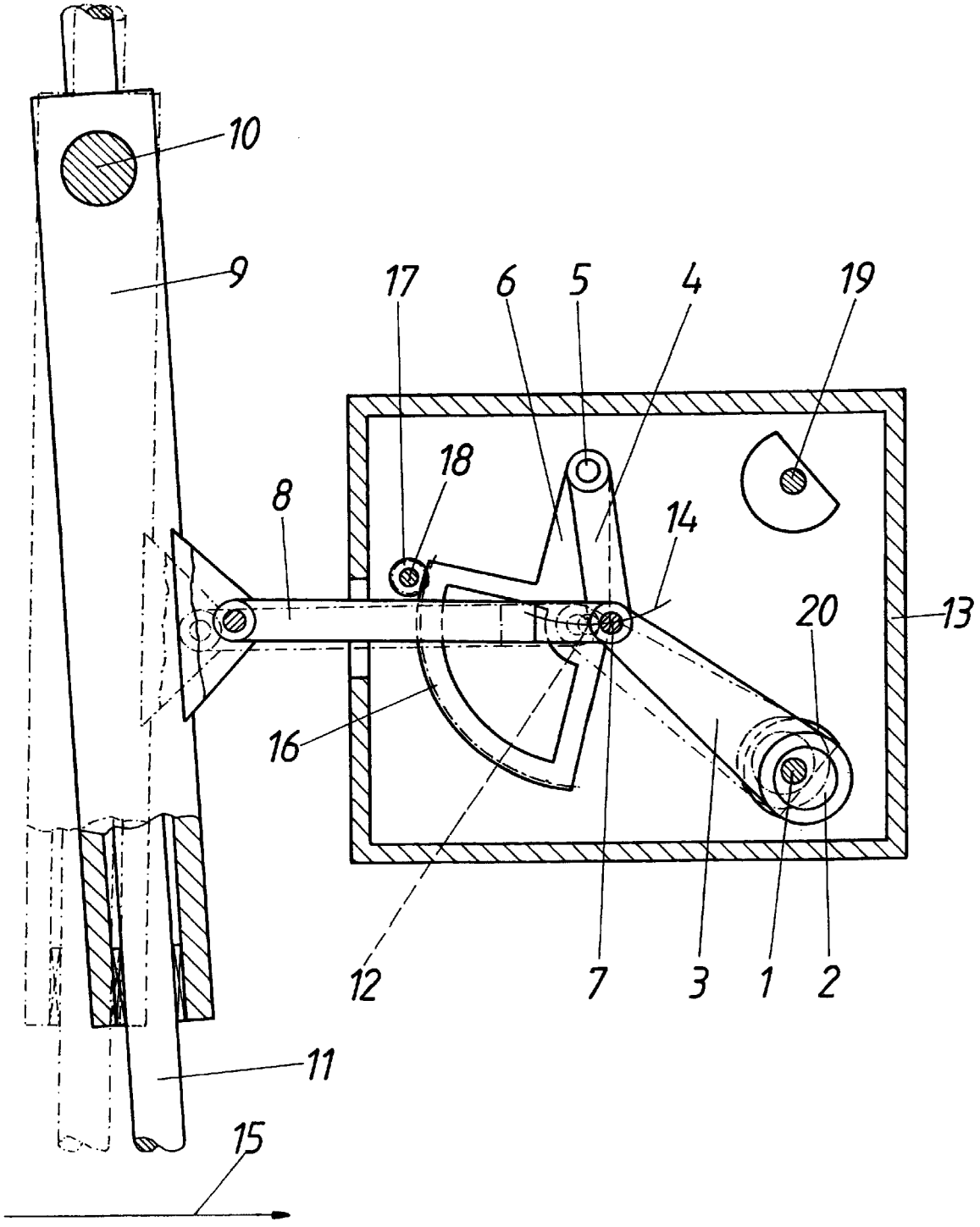
FIG. 3 shows this eccentric drive in a representation acc. to FIG. 1, however, in an adjustment for a great rocking amplitude.

Via a crank arm 6 borne rotatable around an axle 12 in an enclosure 13 accommodating the eccentric drive, the swivel bearing 5 for the rocker arm 4 can be displaced between two end positions as depicted in FIG. 1 and FIG. 3. In the end position represented in FIG. 1 the rocker arm 4 is stretched in its neutral rocking position as against the connecting pitman 8. This means, that the articulating axle 7 between the rocker arm 4 and the connecting pitman 8 moves along a circular arc 14 when driven via the connecting rod 3, which circular arc 14 runs transverse to the connecting pitman 8, so that the lifting motion of the connecting pitman 8 in fleece feed direction 15 is small, as can be inferred from the dash-dotted rocking position.

In the end position of the crank arm 6, offset by 90° as against the rotary position as depicted in FIG. 1, the circular arc motion 14 of the articulating axle 7 is running approximately in the direction of the connecting pitman 8, leading to a maximum rocking amplitude of the guide sleeve 9 around the axle 10. The two reversing positions of the rocking motion are outlined in full lines and dash-dotted in FIG. 3. Thus, via a rotation of the crank arm 6 the rocking amplitude of the needle board in fleece feed direction 15 may be adjusted at will between two limit values, resulting from the neutral rocking position of the rocker arm 4 in the direction of the connecting pitman 8 and transverse thereto, as can be inferred from FIG. 1 and FIG. 2.

For rotation of the crank arm 6, the latter is provided with a toothed quadrant 16 meshing with a driving pinion 17. The driving pinions 17 also provided on both sides corresponding to the crank arm parts are driven via a common actuator shaft 18 borne in the enclosure 13 and permitting a simple rotary adjustment of the crank arm 6 also during driving of the eccentric shaft 1.

For the sake of completeness it shall be pointed out that an additional balancer shaft 19 may be provided, which, together with the balancing mass 20 of the eccentric shaft 1, ensures an appropriate mass balance.

What is claimed is:

1. Facility for needling a fleece with at least one needle board driven to and fro in a stitching direction, which can additionally be driven in pendulum fashion in a fleece feed direction by means of an eccentric drive provided with an assembly consisting of a connecting rod articulated a rocker arm and a connecting pitman connecting the needle board to the connecting rod-rocker arm assembly, the rocker arm having a swivel bearing seated on a rotatable crank arm and the connecting pitman having a rocking amplitude adjustable by adjusting a neutral rocking position of the rocker arm by the crank arm between an end position essentially running in the direction of the connecting pitman and an end position running transverse thereto.

2. Facility according to claim 1, wherein the connecting rod, the rocker arm and the connecting pitman are interlinked by a common articulating axle.

3. Facility according to claim 1, wherein the crank arm is provided with a toothed quadrant meshing with a driving pinion.

* * * * *